US009620915B2

(12) United States Patent
Lu

(10) Patent No.: US 9,620,915 B2
(45) Date of Patent: Apr. 11, 2017

(54) CABLE TV COAXIAL VIDEO AND NETWORK TRANSMITTER AND INSERTION SEAT THEREOF

(71) Applicant: LANTEK ELECTRONICS INC., New Taipei (TW)

(72) Inventor: Shan-Jui Lu, New Taipei (TW)

(73) Assignee: LANTEK ELECTRONICS INC., New Taipei (TW)

( * ) Notice: Subject to any disclaimer, the term of this patent is extended or adjusted under 35 U.S.C. 154(b) by 0 days.

(21) Appl. No.: 14/948,054

(22) Filed: Nov. 20, 2015

(65) Prior Publication Data

US 2016/0365687 A1 Dec. 15, 2016

(30) Foreign Application Priority Data

Jun. 11, 2015 (TW) ..... 104209330 U

(51) Int. Cl.

| | |
|---|---|
| ***H01R 13/6466*** | (2011.01) |
| ***H01R 13/518*** | (2006.01) |
| ***H01R 25/00*** | (2006.01) |
| ***H01R 24/38*** | (2011.01) |
| *H01R 107/00* | (2006.01) |

(52) U.S. Cl.
CPC ..... *H01R 25/006* (2013.01); *H01R 24/38* (2013.01); *H01R 2107/00* (2013.01)

(58) Field of Classification Search
CPC H01R 13/6658; H01R 23/025; H01R 13/518; H01R 2201/16; H01R 13/6466; H01R 13/6469
USPC ..... 439/76.1, 535
See application file for complete search history.

(56) References Cited

U.S. PATENT DOCUMENTS 8,317,550 B2 * 11/2012 Cao ..... H01R 4/48 439/816

FOREIGN PATENT DOCUMENTS

TW 424992 3/2001

* cited by examiner

*Primary Examiner* — Gary Paumen
(74) *Attorney, Agent, or Firm* — Guice Patents PLLC

(57) ABSTRACT

A cable TV coaxial video and network transmitter includes: a top cover having plural signal transmitting ports at peripheral positions thereof; plural connection guiding seats, wherein the bottom surfaces thereof are respectively protruded with a conductive pin; a bottom cover, combined with the top cover, and the interior thereof is installed with a printed circuit board; and plural insertion seats, fastened on the printed circuit board corresponding to the conductive pins, wherein one side of each of the insertion seats is formed with at least one connection leg, and the other side thereof is formed with an elastic clipping end having the interior formed with a pair of clamping segments, the contact length and the contact area between the pair of clamping segments and each of the conductive pins can be determined according to the dimension of the pair of clamping segments.

6 Claims, 7 Drawing Sheets

A-A

CABLE TV COAXIAL VIDEO AND NETWORK TRANSMITTER AND INSERTION SEAT THEREOF

BACKGROUND OF THE INVENTION

1. Field of the Invention

The present invention relates to a cable TV coaxial video and network transmitter, especially to a cable TV coaxial video and network transmitter capable of improving the quality of RF signals emitted by a cable TV system and allowing a high current to pass.

2. Description of Related Art

A cable TV system is to utilize a signal transmitting cable to transmit the signals emitting by each channel and gathered by a base station to each client, the base station and the clients are in a one to multiple relation, and there are certain distances between the base station and each of the clients; for prevent the signals from attenuating during the long-distance transmitting process and for performing operations such as signal distributing and adapting, a cable TV coaxial video and network transmitter (such a line passive component) is utilized for transmitting signals to a splitter so as to be respectively transmitted to each of the clients, thus services such as providing various channels, telecommunication, internet and satellite signals can be provided. In actual practice, the line passive component includes: a power inserter, a directional coupler or a 2/3 way line splitter.

Take the Taiwan Utility Patent NO. 424992 for instance, when a conductive sleeve served as an insertion seat is inserted in a conductive post of a conductive seat, the contact length between the two is 6 mm to 8 mm. As shown in FIG. 1, when the conductive post is inserted in the conductive sleeve, the return loss at the input end and at the output end with the frequency being at 1218 MHz is higher than the baseline, so the transmitting quality for the RF signals would be affected.

At present, the bandwidth provided by the cable TV system is between 5 MHz to 1002 MHz; and the desire of increasing the bandwidth is limited by the natural characteristic differences between active and passive components inside the cable TV coaxial video and network transmitter, thereby not being able to be achieved. As such, services which can be provided by a cable TV company are restrained by the bandwidth.

In view of the bandwidth of the conventional transmitter not being able to be increased, how to increase the current frequency between 5 MHz to 1002 MHz to between 5 MHz to 1218 MHz for providing more services such as more channels, telecommunication, internet service and satellite signals are a serious issue to be concerned by the skilled people in the art.

SUMMARY OF THE INVENTION

One primary objective of the present invention is to provide a cable TV coaxial video and network transmitter (such as a line passive component), in which an insertion seat installed therein is improved, so after the insertion seat allows a conductive pin of a connection guiding seat to be inserted, the contact length and the contact area between the insertion seat and the conductive pin are able to be reduced for enabling the bandwidth of the cable TV coaxial video and network transmitter to be increased and ensuring the quality of RF signals provided by a cable TV system.

For achieving said objective, one technical solution provided by the present invention is to provide a cable TV coaxial video and network transmitter, which includes: a top cover, having a plurality of signal transmitting ports at peripheral positions thereof; a plurality of connection guiding seats, wherein the quantity thereof is corresponding to the quantity of the signal transmitting ports, and the connection guiding seats are locked and fastened inside the top cover, each of the connection guiding seats is formed with a first opening arranged adjacent to each of the signal transmitting ports, the bottom surface of each of the connection guiding seats is longitudinally protruded with a conductive pin; a bottom cover, combined with the bottom end of the top cover for forming a sealed status, wherein the interior of the bottom cover is installed with a printed circuit board; and a plurality of insertion seats, wherein the quantity thereof is corresponding to the quantity of the connection guiding seats, the insertion seats are fastened on the printed circuit board corresponding to the plural conductive pins, one side of each of the insertion seats is formed with at least one connection leg inserted in the printed circuit board, and the other side thereof is formed with an elastic clipping end, the interior of the clipping end is formed with a pair of arc-shaped clamping segments symmetrically arranged and allowing each of the conductive pins to be inserted, the contact length and the contact area between the pair of clamping segments and each of the conductive pins are able to be determined according to the dimension of the pair of clamping segments, thereby enabling the bandwidth of the transmitter to be adjusted; wherein, the thickness of each of the insertion seats is between 0.5 mm to 0.7 mm, the total height is between 6 mm to 8 mm, and the contact length between the pair of clamping segments and each of the conductive pins is between 2 mm to 4 mm.

Another objective of the present invention is to provide an insertion seat of a cable TV coaxial video and network transmitter, in which the structure thereof is improved, so after the insertion seat allows a conductive pin of a connection guiding seat to be inserted, the contact length and the contact area between the insertion seat and the conductive pin are able to be reduced for enabling the bandwidth of the cable TV coaxial video and network transmitter to be increased and ensuring the quality of RF signals provided by a cable TV system.

For achieving said objective, one technical solution provided by the present invention is to provide an insertion seat of a cable TV coaxial video and network transmitter, wherein one side thereof is formed with at least one connection leg and the other side thereof is formed with an elastic clipping end, the interior of the clipping end is formed with a pair of arc-shaped clamping segments symmetrically arranged and allowing a conductive pin to be inserted, the contact length and the contact area between the pair of clamping segments and the conductive pin are able to be determined according to the dimension of the pair of clamping segments, thereby enabling the bandwidth of the transmitter to be adjusted; wherein, the thickness of each of the insertion seats is between 0.5 mm to 0.7 mm, the total height is between 6 mm to 8 mm, and the contact length between the pair of clamping segments and the conductive pin is between 2 mm to 4 mm.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
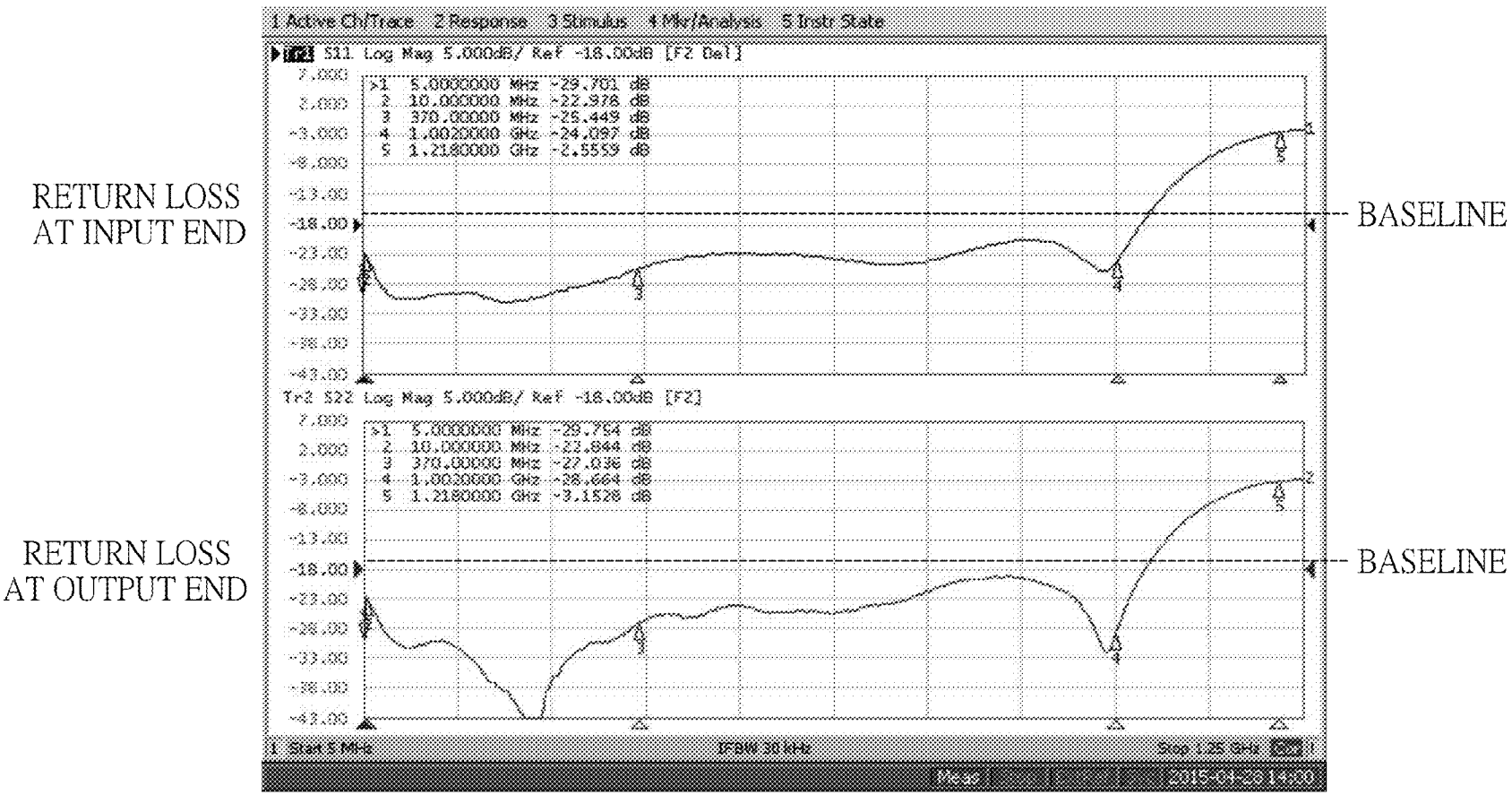
(PRIOR ART) FIG. 1
FIG. 1 is a schematic view illustrating the return loss at the input end and at the output end of a conventional cable TV coaxial video and network transmitter.
Figure 2:
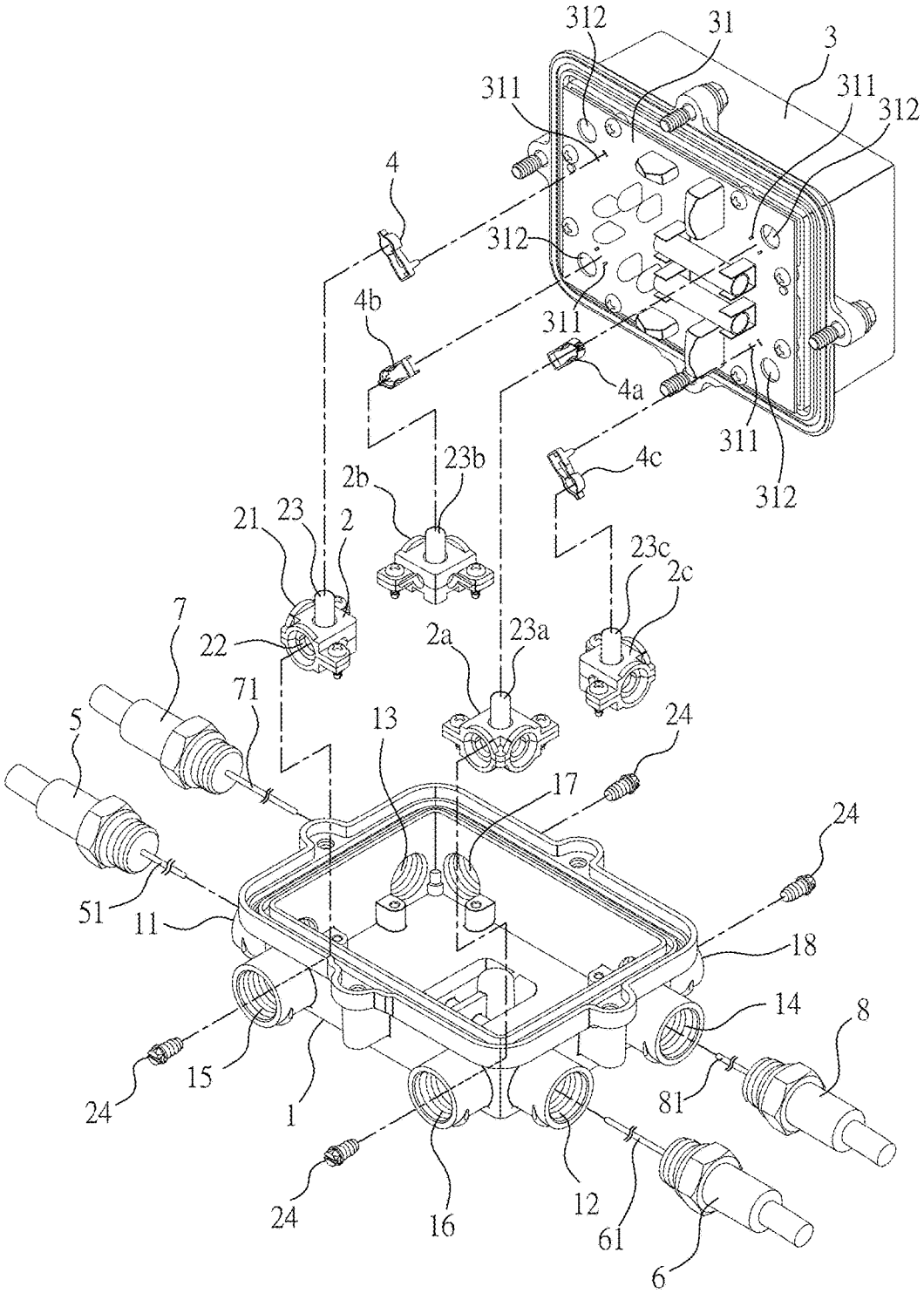
FIG. 2 is a perspective exploded view illustrating the cable TV coaxial video and network transmitter according to the present invention.
Figure 3:
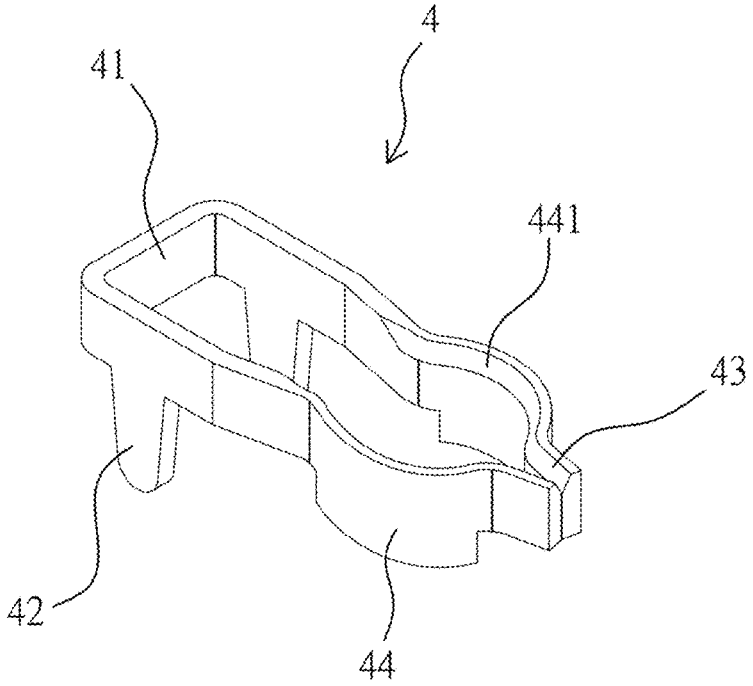
FIG. 3 is a perspective exploded view illustrating the insertion seat according to the present invention.

Referring from FIG. 2 to FIG. 6, the present invention provides a cable TV coaxial video and network transmitter (for example a line passive component), which includes a top cover 1, a plurality of connection guiding seats 2, a bottom cover 3 and insertion seats 4 with the same quantity as the connection guiding seats 2.

The top cover 1 is formed as a cover member made of an aluminum alloy, and has a plurality of signal transmitting ports 11, 12, 13, 14 at peripheral positions thereof (such as two opposite sides). For conveniently arranging the signal transmitting ports 11, 12, 13, 14, the first signal transmitting port 11 and the second signal transmitting port 12, and the third signal transmitting port 13 and the fourth signal transmitting port 14 are respectively and oppositely arranged at two sides of the top cover 1. In addition, vertical directions of the signal transmitting ports 11, 12, 13, 14 are respectively formed with a signal locking port 15, 16, 17, 18. As a matter of fact, the plural signal transmitting ports 11, 12, 13, 14 can be served as the signal locking ports, and the plural signal locking ports 15, 16, 17, 18 are correspondingly served as the signal transmitting ports.

For conveniently identifying the signal locking ports, the signal locking port vertically adjacent to the first signal transmitting port 11 is defined as the first signal locking port 15, the signal locking port vertically adjacent to the second signal transmitting port 12 is defined as the second signal locking port 16 and so on, thereby the other two signal locking ports being respectively defined as the third signal locking port 17 and the fourth signal locking port 18.

The quantity of the connection guiding seats 2 is corresponding to the quantity of the signal transmitting ports, according to this embodiment, the quantity of the signal transmitting ports is four, so four connection guiding seats 2 are provided and respectively defined as a first connection guiding seat 2, a second connection guiding seat 2*a*, a third connection guiding seat 2*b* and a fourth connection guiding seat 2*c*. The connection guiding seats 2, 2*a*, 2*b*, 2*c* are fastened on a base formed inside the top cover 1 for receiving signals transmitted by a base station of a cable TV system.

Because the structures of the four connection guiding seats 2, 2*a*, 2*b*, 2*c* are totally the same, only the first connection guiding seat 2 is adopted for illustration. The first connection guiding seat 2 is formed with a first opening 21, and the first opening 21 is arranged adjacent to the first signal transmitting port 11. Wherein, the vertical direction of the first opening 21 is formed with a second opening 22, and the second opening 22 is arranged adjacent to the first signal locking port 15. Wherein, the bottom surface of the first connection guiding seat 2 is longitudinally protruded with a first conductive pin 23 used for transmitting signals.

As such, when the transmitter is connected to a signal transmitting connector, a first signal transmitting connector 5, a second signal transmitting connector 6, a third signal transmitting connector 7 and a fourth signal transmitting connector 8 arranged at two sides are respectively locked in the first signal transmitting port 11, the second signal transmitting port 12, the third signal transmitting port 13 and the fourth signal transmitting port 14 of the top cover 1, so a first signal transmitting member 51 of the first signal transmitting connector 5, a second signal transmitting member 61 of the second signal transmitting connector 6, a third signal transmitting member 71 of the third signal transmitting connector 7 and a fourth signal transmitting member 81 of the fourth signal transmitting connector 8 are allowed to respectively pass the first openings 21 of the first connection guiding seat 2, the second connection guiding seat 2*a*, the third connection guiding seat 2*b* and the fourth connection guiding seat 2*c* and be respectively inserted in main bodies of the first conducive pin 23, a second conductive pin 23*a*, a third conductive pin 23*b* and the fourth conductive pin 23*c*, then four cable securing screws 24 are provided for respectively passing the first signal locking port 15, the second signal locking port 16, the third signal locking port 17 and the fourth signal locking port 18 and the second openings 22 of the first connection guiding seat 2, the second connection guiding seat 2*a*, the third connection guiding seat 2*b* and the fourth connection guiding seat 2*c*, then respectively locked in the main bodies of the first conductive pin 23, the second conductive pin 23*a*, the third conductive pin 23*b* and the fourth conductive pin 23*c*, thereby allowing the first signal transmitting member 51, the second signal transmitting member 61, the third signal transmitting member 71 and the fourth signal transmitting member 81 to be locked with each of the conductive pins 23, 23*a*, 23*b*, 23*c* of the first connection guiding seat 2, the second connection guiding seat 2*a*, the third connection guiding seat 2*b* and the fourth connection guiding seat 2*c*.

The bottom cover 3 is formed as a cover member made of an aluminum alloy and combined (such as screw-fitted) with the bottom end of the top cover 1, thereby being formed as a sealed shell body. The interior of the bottom cover 3 is installed with a printed circuit board 31, the printed circuit board 31 is installed with a first insertion seat 4, a second insertion seat 4*a*, a third insertion seat 4*b* and a fourth insertion seat 4*c* corresponding to the plural conductive pins 23, 23*a*, 23*b*, 23*c* of each of the connection guiding seats 2, 2*a*, 2*b*, 2*c*, and the plural insertion seats 4, 4*a*, 4*b*, 4*c* allow each of the conductive pins 23, 23*a*, 23*b*, 23*c* to be inserted for forming a signal conducting status.

As shown in FIG. 2, FIG. 3, FIG. 5 and FIG. 6, because the structures of the first insertion seat 4, the second insertion seat 4*a*, the third insertion seat 4*b* and the fourth insertion seat 4*c* are totally the same, only the first insertion seat 4 is adopted for illustration. The first insertion seat 4 is formed in an elongated triangle-like status, and one side thereof is formed with a closed end 41 having at least one connection leg 42, the connection leg 42 is inserted in a connection hole 311 preformed on the printed circuit board 31 and welded thereon for being fastened. The other side thereof is formed with an elastic clipping end 43, the interior of the clipping end 43 is formed with a pair of arc-shaped clamping segments 44 symmetrically arranged and allowing each of the conductive pins 23, 23*a*, 23*b*, 23*c* to be inserted, and the printed circuit board 31 is respectively formed with a board hole 312 adjacent to the pair of clamping segments 44 and allowing each of the conductive pins 23, 23*a*, 23*b*, 23*c* to be inserted. Wherein, the top ends of the pair of clamping segments 44 are formed with a pair of guiding inclined surfaces 441 protruded inwardly. As such, the contact length and the contact area between the pair of clamping segments 44 and each of the conductive pins 23, 23*a*, 23*b*, 23*c* can be determined according to the dimension design of the pair of clamping segments 44, thereby allowing the bandwidth of the transmitter and the quality of RF signals to be adjusted.

As a matter of fact, the first insertion seat 4 is made of a metal sheet being punched and bent for forming as an elongated triangle-like clipping member, wherein the thickness of the metal sheet is between 0.5 mm to 0.7 mm, the total height including the connection leg 42 is between 6 mm to 8 mm, and the contact length between the pair of clamping segments 44 and the conducive pin 23 is between 2 mm to 4 mm, so the following features can be ensured:

(1) The plural insertion seats 4, 4*a*, 4*b*, 4*c* are able to sustain the pulling forces applied by the plural conductive pins 23, 23*a*, 23*b*, 23*c*, so situations such as loosening and falling can be prevented.

(2) For the RF signals transmitted by the cable TV system, when the plural insertion seats 4, 4*a*, 4*b*, 4*c* and the plural conductive pins 23, 23*a*, 23*b*, 23*c* of the transmitter are combined, because the plural insertion seats 4, 4*a*, 4*b*, 4*c* are formed as an individual metal component, an inducing status generated between a plastic component and the printed circuit board can be avoided, and a situation of the plastic component being melted due to high temperature generated while a high current passing the plastic components can also be avoided; and the plural insertion seats 4, 4*a*, 4*b*, 4*c* and the plural conductive pins 23, 23*a*, 23*b*, 23*c* are not in a 360-degree fully contacting status, so interferences applied to electronic components on the transmitter can be reduced and improved, and the plural insertion seats 4, 4*a*, 4*b*, 4*c* have a proper metal material thickness, so a larger current is allowed to pass and damages to the transmitter caused by thunder strikes can be sustained.

(3) The quality of RF signals having the bandwidth from 5 MHz to 1218 MHz provided by the cable TV system can be ensured.

Figure 4:
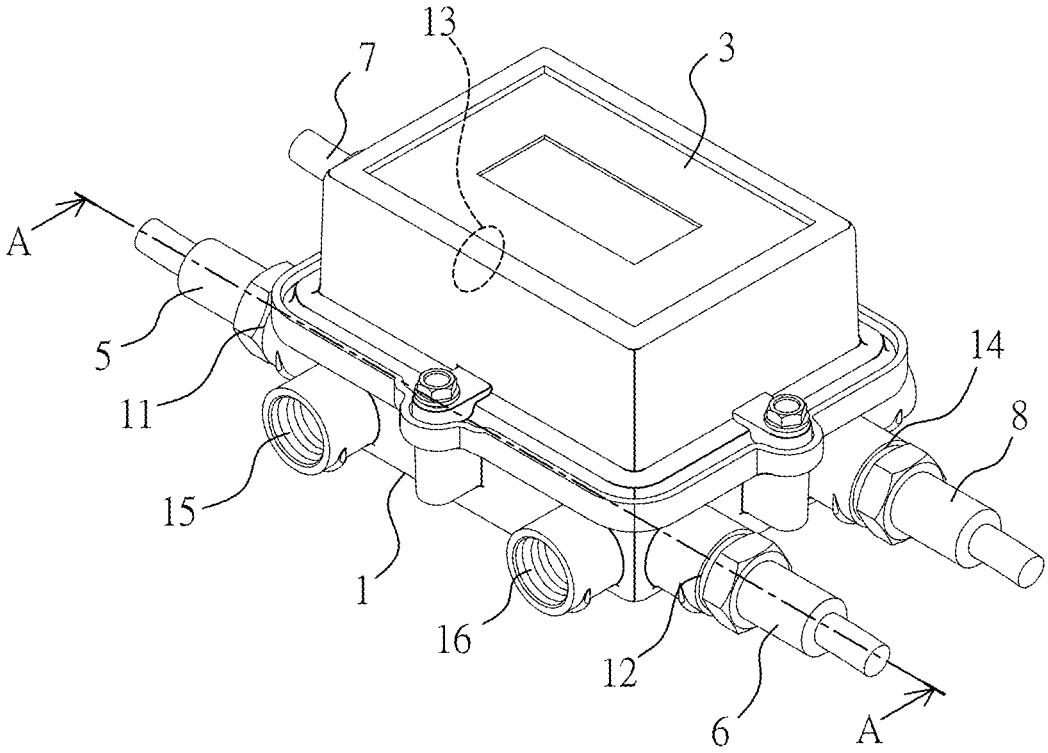
FIG. 4 is a perspective view illustrating the assembly of the cable TV coaxial video and network transmitter and a signal transmitter connector.
Figure 5:
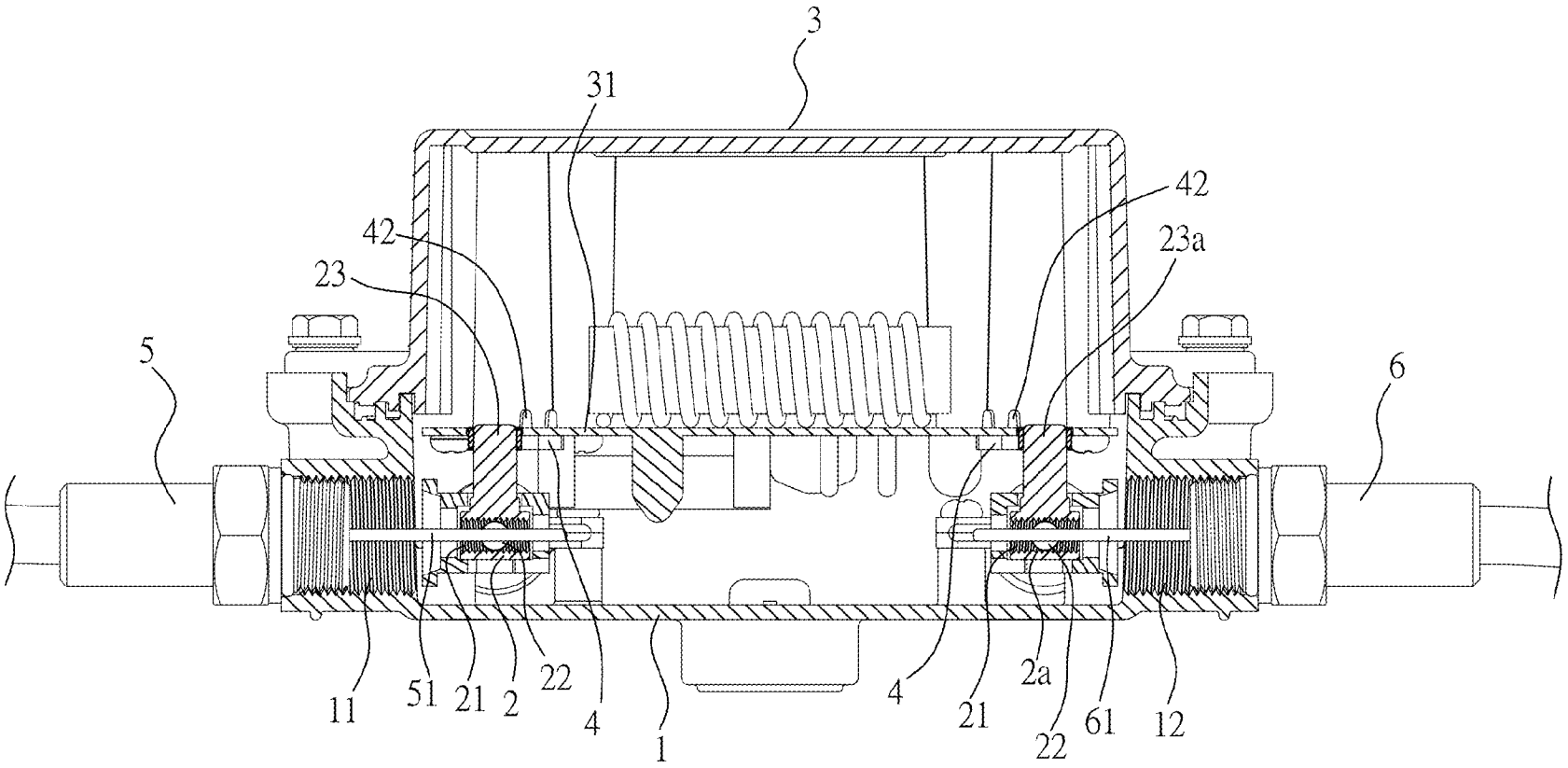
FIG. 5 is a cross sectional view of FIG. 4 taken along line A-A.
Figure 6:
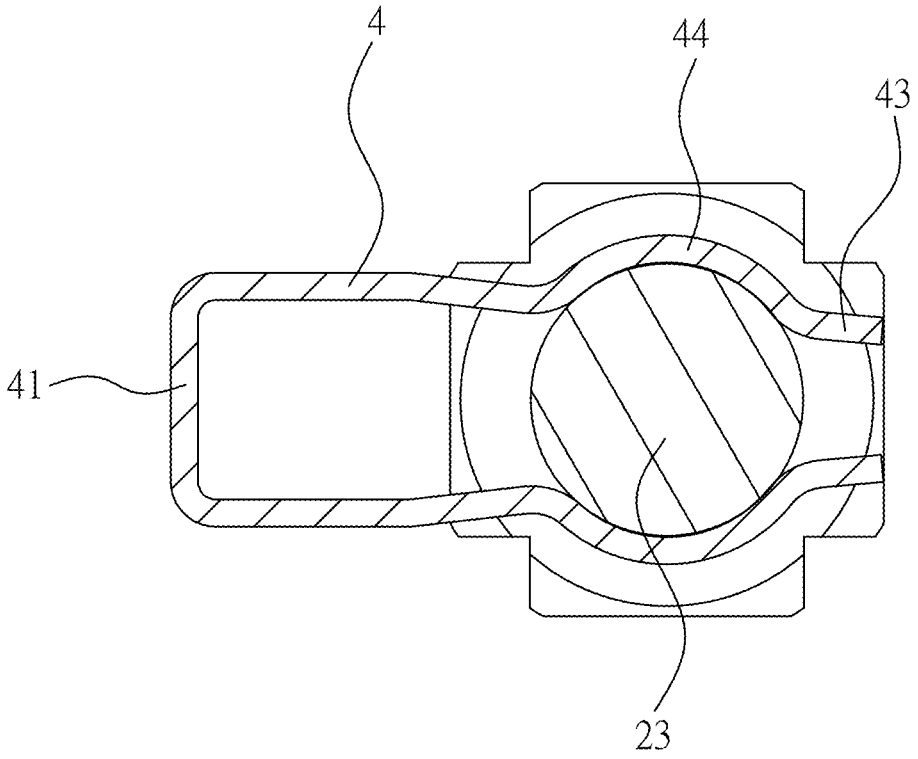
FIG. 6 is a cross sectional view illustrating the conductive pin being inserted in the insertion seat according to the present invention.

As shown in FIG. 4 and FIG. 5, after the transmitter provided by the present invention is assembled, RF signals provided by a base station of the cable TV system are able to enter the transmitter (for example the line passive component) from the first signal transmitting port 11 and through the first signal transmitting connector 5 and the first signal transmitting member 51, then the signals are transmitted to the printed circuit board 31 through the first conductive pin 23 of the first connection guiding seat 2 and the first insertion seat 4; after the RF signals are converted by the printed circuit board 31, different signal transmitting paths can be generated with respect to different products of the line passive component.

When the line passive component is a power inserter, not only the above-mentioned RF signals are transmitted to the printed circuit board 31 through the first signal transmitting port 11, the first conductive pin 23 of the first connection guiding seat 2 and the first insertion seat 4, a power supply is also provided for entering the line passive component from the third signal transmitting port 13 and through the third signal transmitting connector 7 and the third signal transmitting member 71, then transmitted to the printed circuit board 31 through the third conductive pin 23*b* of the third connection guiding seat 2*b* and the third insertion seat 4*b*; and the RF signals and the power received and converted by the printed circuit board 31 are respectively transmitted to the first conductive pin 23 and the second conductive pin 23*a* of the first connection guiding seat 2 and the second connection guiding seat 2*a* respectively through the first insertion seat 4 and the second insertion seat 4*a*, then transmitted to a network of the cable TV system through the first signal transmitting member 51, the second signal transmission member 61, the first signal transmitting connector 5 and the second signal transmitting connector 6.

When the line passive component is a directional coupler or 2/3 way line splitter, the RF signals enter the line passive component from the first signal transmitting port 11 and through the first signal transmitting connector 5 and the first signal transmitting member 51, then the signals are transmitted to the printed circuit board 31 through the first conductive pin 23 of the first connection guiding seat 2 and the first insertion seat 4, after the signals are converted by the printed circuit board 31, the RF signals are respectively transmitted to each of the conductive pins 23*a*, 23*b*, 23*c* of the plural connection guiding seats 2*a*, 2*b*, 2*c* through the plural insertion seats 4*a*, 4*b*, 4*c* according to the actual needs, then the second signal transmitting member 61, the third signal transmitting member 71, the fourth signal transmitting member 81, the second signal transmitting connector 6, the third signal transmitting connector 7 and the fourth signal transmitting connector 8 are utilized for transmitting the RF signals to the network of the cable TV system.

Figure 7:
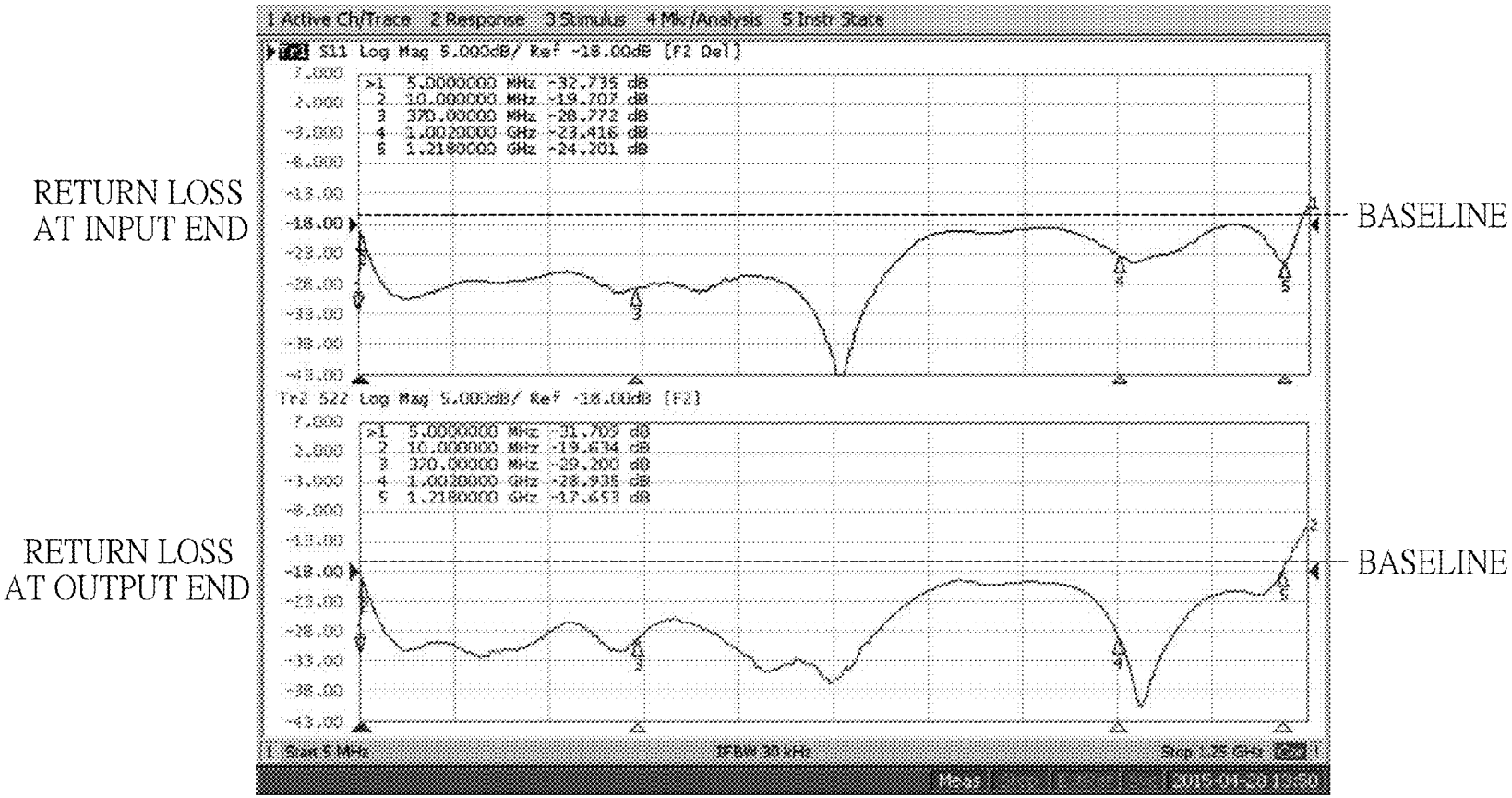
FIG. 7 is a schematic view illustrating the return loss at the input end and at the output end of the cable TV coaxial video and network transmitter according to the present invention.

As shown in FIG. 7, when the transmitter is in actual use, the return loss at the input end and at the output end with the frequency between 5 MHz to 1218 MHz is able to be controlled for being under the baseline; as such, with the line shape differences of the return loss at the input end and at the output end disclosed in FIG. 1 and FIG. 7, it is obvious that the contact length and the contact area between each of the insertion seats 4 and each of the conductive pins 23 would affect the bandwidth and the quality of RF signals.

Based on what has disclosed above, advantages achieved by the present invention are as followings: the insertion seat is able to be extend and improve the quality of the RF signals having high frequency from 900 MHz to 1218 MHz provided by the cable TV system, so the cable TV system is enabled to increase the current frequency between 5 MHz to 1002 MHz to between 5 MHz to 1218 MHz for providing more services such as more channels, telecommunication, internet and satellite signals; moreover, the insertion seat is able to ensure the contact length and the contact area to be optimal when the conductive pins are inserted, and the electric characteristic of the electronic components on the printed circuit board can be prevented from being altered, and enough contact areas are provided for enabling the transmitter to sustain high current (10-12 A) and allowing the transmitter not to be damaged by thunder strikes, so the quality of RF signals provided by cable TV system can be ensured. Accordingly, the cable TV coaxial video and network transmitter provided by the present invention is novel and more practical in use comparing to prior arts.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A cable TV coaxial video and network transmitter, comprising:

a top cover, having a plurality of signal transmitting ports at peripheral positions thereof;

a plurality of connection guiding seats, wherein the quantity thereof is corresponding to the quantity of said signal transmitting ports, and said connection guiding seats are locked and fastened inside said top cover, each of said connection guiding seats is formed with a first opening arranged adjacent to each of said signal transmitting ports, the bottom surface of each of said connection guiding seats is longitudinally protruded with a conductive pin;

a bottom cover, combined with the bottom end of said top cover for forming a sealed status, wherein the interior of said bottom cover is installed with a printed circuit board; and a plurality of insertion seats, wherein the quantity thereof is corresponding to the quantity of said connection guiding seats, said insertion seats are fastened on said printed circuit board corresponding to said conductive pins, one side of each of said insertion seats is formed with at least one connection leg inserted in said printed circuit board, and the other side thereof is formed with an elastic clipping end, the interior of said clipping end is formed with a pair of arc-shaped clamping segments symmetrically arranged and allowing each of said conductive pins to be inserted, the contact length and the contact area between said pair of clamping segments and each of said conductive pins are able to be determined according to the dimension of said pair of clamping segments; wherein, the thickness of each of said insertion seats is between 0.5 mm to 0.7 mm, the total height is between 6 mm to 8 mm, and the contact length between said pair of clamping segments and each of said conductive pins is between 2 mm to 4 mm;

each insertion seat extending and improving a quality of RF signals, the RF signals having a high frequency in a range of 900 MHz to 1218 MHz provided by a cable TV system, and the cable TV system is enabled to increase the current frequency from a range between 5 MHz to 1002 MHz to a range between 5 MHz to 1218 MHz for providing more services selected from a group consisting of more channels, telecommunication, internet and satellite signals, and a combination thereof.

2. The cable TV coaxial video and network transmitter as claimed in claim 1, wherein the vertical direction of each of said signal transmitting ports is respectively formed with a signal locking port; the vertical direction of said first opening of each of said connection guiding seats is respectively formed with a second opening, and each of said second openings is arranged adjacent to each of said signal locking ports, and a cable securing screw is respectively provided for passing each of said signal locking ports and each of said second openings then locked in a main body of each of said conductive pins.

3. The cable TV coaxial video and network transmitter as claimed in claim 1, wherein said printed circuit board is respectively formed with a board hole arranged adjacent to said pair of clamping segments and allowing each of said conductive pins to be inserted.

4. The cable TV coaxial video and network transmitter as claimed in claim 1, wherein the top ends of said pair of clamping segments are formed with a pair of guiding inclined surfaces protruding inwardly from an interior surface thereof.

5. An insertion seat of a cable TV coaxial video and network transmitter comprising:

an insertion seat body, one side thereof is formed with at least one connection leg and the other side thereof is formed with an elastic clipping end, the interior of said clipping end is formed with a pair of arc-shaped clamping segments symmetrically arranged and allowing a conductive pin to be inserted, the contact length and the contact area between said pair of clamping segments and said conductive pin are able to be determined according to the dimension of said pair of clamping segments; wherein, the thickness of each of said insertion seat is between 0.5 mm to 0.7 mm, the total height is between 6 mm to 8 mm, and the contact length between said pair of clamping segments and said conductive pin is between 2 mm to 4 mm;

wherein the insertion seat extending and improving a quality of RF signals, the RF signals having a high frequency in a range of 900 MHz to 1218 MHz provided by a cable TV system, and the cable TV system is enabled to increase the current frequency from a range between 5 MHz to 1002 MHz to a range between 5 MHz to 1218 MHz for providing more services selected from a group consisting of more channels, telecommunication, internet and satellite signals, and a combination thereof.

6. The insertion seat of a cable TV coaxial video and network transmitter as claimed in claim 5, the top ends of said pair of clamping segments are formed with a pair of guiding inclined surfaces protruding inwardly from an interior surface thereof.

* * * * *